US011614087B2

(12) United States Patent
Chen et al.

(10) Patent No.: US 11,614,087 B2
(45) Date of Patent: Mar. 28, 2023

(54) COMPRESSOR HAVING INTERMEDIATE PASSAGE CAPABLE OF CONVEYING ACCUMULATED OIL TO A SECOND COMPRESSION PART AND AIR CONDITIONER INCLUDING SAME

(71) Applicant: GREE GREEN REFRIGERATION TECHNOLOGY CENTER CO., LTD. OF ZHUHAI, Zhuhai (CN)

(72) Inventors: Sheng Chen, Zhuhai (CN); Jian Wu, Zhuhai (CN); Ouxiang Yang, Zhuhai (CN); Peng Zou, Zhuhai (CN); Dajun Ke, Zhuhai (CN); Huifang Luo, Zhuhai (CN); Xixing Liu, Zhuhai (CN)

(73) Assignee: GREE GREEN REFRIGERATION TECHNOLOGY CENTER CO., LTD. OF ZHUHAI, Zhuhai (CN)

( * ) Notice: Subject to any disclaimer, the term of this patent is extended or adjusted under 35 U.S.C. 154(b) by 409 days.

(21) Appl. No.: 16/650,633

(22) PCT Filed: Jun. 5, 2018

(86) PCT No.: PCT/CN2018/089962
§ 371 (c)(1),
(2) Date: Mar. 25, 2020

(87) PCT Pub. No.: WO2019/104983
PCT Pub. Date: Jun. 6, 2019

(65) Prior Publication Data

US 2020/0284247 A1 Sep. 10, 2020

(30) Foreign Application Priority Data

Nov. 30, 2017 (CN) ..... 201711243152.4

(51) Int. Cl.
*F04C 18/356* (2006.01)
*F04B 25/00* (2006.01)
(Continued)

(52) U.S. Cl.
CPC ..... *F04C 18/3564* (2013.01); *F04B 25/005* (2013.01); *F04B 39/0276* (2013.01);
(Continued)

(58) Field of Classification Search
CPC .... F04C 23/001; F04C 23/003; F04C 23/005; F04C 23/006; F04C 15/0088;
(Continued)

(56) References Cited

U.S. PATENT DOCUMENTS 5,242,280 A * 9/1993 Fujio ..... F04C 23/008 418/268
2011/0165004 A1* 7/2011 Park ..... F04C 18/3564 418/5
2014/0105774 A1* 4/2014 Shin ..... F04C 23/001 418/5

FOREIGN PATENT DOCUMENTS

CN 103727035 A 4/2014
CN 108087273 A 5/2018
(Continued)

OTHER PUBLICATIONS

International Search Report for corresponding PCT/CN2018/089962 dated Sep. 7, 2018, 2 pages.

*Primary Examiner* — Laert Dounis
(74) *Attorney, Agent, or Firm* — Armstrong Teasdale LLP

(57) ABSTRACT

Some embodiments of the present disclosure provide a compressor and an air conditioner with the compressor. The compressor includes: a first compression part, a second compression part, an intermediate cavity and an intermediate passage. Refrigerant discharged from the first compres-
(Continued)

sion part enters the intermediate cavity. The intermediate passage communicates with the intermediate cavity and an inner cavity of the second compression part. A bottom port of the intermediate passage is located at a bottom of the intermediate cavity, and air supplement refrigerant and/or the refrigerant discharged from the first compression part are used to convey accumulated oil in the intermediate cavity to the inner cavity of the second compression part. When only the refrigerant is used to convey the accumulated to the inner cavity of the second compression part, at least a part of the intermediate passage is located outside of a housing assembly of the compressor.

17 Claims, 22 Drawing Sheets

(51) Int. Cl.

| | |
|---|---|
| ***F04B 39/02*** | (2006.01) |
| ***F25B 31/00*** | (2006.01) |
| ***F04B 39/12*** | (2006.01) |
| ***F04B 39/04*** | (2006.01) |
| ***F04C 29/02*** | (2006.01) |
| ***F04C 29/00*** | (2006.01) |
| ***F04C 23/00*** | (2006.01) |

(52) U.S. Cl.
CPC ..... *F04B 39/0292* (2013.01); *F04B 39/04* (2013.01); *F04B 39/12* (2013.01); *F04C 18/3562* (2013.01); *F04C 23/001* (2013.01); *F04C 29/00* (2013.01); *F04C 29/02* (2013.01); *F04C 29/028* (2013.01); *F25B 31/002* (2013.01); *F04C 2240/30* (2013.01)

(58) Field of Classification Search
CPC ..... F04C 29/02–028; F04C 2/34–3568; F04C 18/34–3568; F01C 21/04–045; F01C 1/34–3568
See application file for complete search history.

(56) References Cited

FOREIGN PATENT DOCUMENTS

| | | | | |
|---|---|---|---|---|
| CN | 207568840 | U | | 7/2018 |
| EP | 2733306 | A2 | | 5/2014 |
| JP | H05133367 | A | | 5/1993 |
| KR | 20060093962 | A | * | 8/2006 |
| KR | 20090012865 | A | | 2/2009 |

* cited by examiner

-- PRIOR ART --

COMPRESSOR HAVING INTERMEDIATE PASSAGE CAPABLE OF CONVEYING ACCUMULATED OIL TO A SECOND COMPRESSION PART AND AIR CONDITIONER INCLUDING SAME

Cross-Reference to Related Applications

The present disclosure is a national stage application of International Patent Application No. PCT/CN2018/089962, filed on Jun. 5, 2018, which claims priority to Chinese Patent Application No. 201711243152.4, filed on Nov. 30, 2017, and entitled "Compressor and Air Conditioner with Compressor," the contents of which are hereby incorporated by reference in their entirety.

TECHNICAL FIELD

The disclosure relates to a field of compressors, in particular to a compressor and an air conditioner with the compressor.

BACKGROUND

With the improvement of people's living quality, and attention to environmental protection, air conditioning heat pumps and other environment-friendly heating methods are adopted in winter, so low temperature heating capacity and energy efficiency of an air conditioner attract more and more attention. To adapt to heating in north cold areas, higher and higher heating capacity and energy efficiency of an air conditioning system are required. A two-stage enthalpy adding compressor is widely applied in a heat pump air conditioning system due to its characteristics of producing a lot of heat at low temperature, and adapting to a wide operating temperature range.

There is often a large accumulation of oil in an intermediate cavity of a two-stage enthalpy adding compressor (referring to FIG. 1) known to inventors; if the accumulated oil in the intermediate cavity cannot be discharged in time, a secondary cylinder will inhale excessive accumulated oil instantaneously, and then an oil squeezing phenomenon appears in a second compression part, which causes a resistance moment of the second compression part of the compressor to fluctuate greatly, and makes a motor torque output not stable, thereby causing an instantaneous current to increase and even causing the compressor to shut down. At the same time, because compression resistance of the second compression part of the compressor is great, a head of a sliding vane of the second compression part is stressed greatly, which causes the sliding vane to separate from a roller; as a result, the sliding vane hits the roller or a groove bottom hole, which impacts the reliability of the compressor.

As shown in FIG. 1, the compressor known to the inventors includes a first compression part 10', a second compression part 20', an intermediate cavity 30', an intermediate passage 40', an air supplement passage 50', a first flange 60', a first cover plate 70', a division plate 80', a housing assembly 90', and an enthalpy adding part 100'. The accumulated oil discharged from the first compression part 10' adheres to and coagulates on a cavity wall of the intermediate cavity 30' once touching the cavity wall, and accumulates gradually. An outlet of the intermediate cavity 30' is arranged on the top (namely a bottom port of the intermediate passage 40' is disposed at an upper part of the intermediate cavity 30'), and the amount of the accumulated oil discharged along with medium pressure air buffered by the intermediate cavity 30' is limited. When the intermediate cavity 30' is full of the accumulated oil, the second compression part 20' sucks air, and the amount of air is reduced to create a vacuum; then, the accumulated oil is directly sucked into the second compression part 20', as a result, a phenomenon of instantaneous absorption of a large amount of oil appear. In addition, because refrigerant discharged from the first compression part 10' takes only the accumulated oil on the level to the intermediate passage, the speed of discharging the accumulated oil in the intermediate cavity from the intermediate cavity is low. That is, in the compressor known to the inventors, the efficiency of discharging the accumulated oil in the intermediate cavity from the intermediate cavity is comparatively low.

SUMMARY

Some embodiments of the disclosure provide a compressor and an air conditioner with the compressor, so as to solve the problem in the compressor known to the inventors that the efficiency of discharging the accumulated oil in the intermediate cavity from the intermediate cavity is low.

According to an aspect of the disclosure, some embodiments provide a compressor, which includes: a first compression part; a second compression part; an intermediate cavity, refrigerant discharged from the first compression part entering the intermediate cavity; and an intermediate passage, the intermediate passage communicating with the intermediate cavity and an inner cavity of the second compression part. A bottom port of the intermediate passage is located at the bottom of the intermediate cavity, so as to use air supplement refrigerant and the refrigerant discharged from the first compression part to convey accumulated oil in the intermediate cavity to the inner cavity of the second compression part; or, only air supplement refrigerant is used to convey accumulated oil in the intermediate cavity to the inner cavity of the second compression part; or, only the refrigerant discharged from the first compression part is used to convey the accumulated oil in the intermediate cavity to the inner cavity of the second compression part, wherein at least a part of the intermediate passage is disposed outside of a housing assembly of the compressor.

In an exemplary embodiment, the compressor further includes an air supplement passage for conveying air supplement refrigerant.

In an exemplary embodiment, the air supplement passage is communicated with the intermediate cavity, and is disposed below the intermediate cavity.

In an exemplary embodiment, the compressor further includes the housing assembly. The intermediate passage is disposed inside the housing assembly. The air supplement passage is arranged in a radial direction of the first compression part. The intermediate passage is arranged in an axial direction of the first compression part.

In an exemplary embodiment, the compressor further includes an enthalpy adding part communicating with the air supplement passage. The air supplement passage includes: a first passage section and a second passage section. One end of the first passage section communicates with the enthalpy adding part, the other end of the first passage section communicates with one end of the second passage section, and the other end of the second passage section communicates with the intermediate cavity. wherein, an included angle is disposed between a centerline of the first passage section and a centerline of the second passage section.

In an exemplary embodiment, the compressor further includes a drainage structure disposed in the intermediate passage. One end of the drainage structure extends into the intermediate cavity.

In an exemplary embodiment, the compressor further includes: a first flange disposed below the first compression part, a lower side of the first flange being provided with a first cavity; and a first cover plate disposed below the first flange, a side, facing the first flange, of the first cover plate being provided with a second cavity. The first cavity and the second cavity form the intermediate cavity together. An air supplement opening of the air supplement passage is disposed on the bottom wall of the second cavity.

In an exemplary embodiment, the compressor includes a groove disposed on the first cover plate. The air supplement passage communicates with the second cavity through the groove.

In an exemplary embodiment, the compressor further includes a drainage pipe disposed in the intermediate passage. An end, facing the second cavity, of the drainage pipe is set tilted.

In an exemplary embodiment, the first compression part includes a first cylinder, the second compression part includes a second cylinder, and the first cylinder and the second cylinder are superposed. The compressor further includes a division plate disposed between the first cylinder and the second cylinder and a first flange disposed below the first cylinder. The intermediate passage is formed on an assembly consisting of the first cylinder, the second cylinder, the division plate and the first flange.

In an exemplary embodiment, the compressor includes: a first through hole arranged on the second cylinder; a second through hole communicated with the first through hole and arranged on the division plate; a third through hole communicated with the second through hole and arranged on the first cylinder; a fourth through hole communicated with the third through hole and arranged on the first flange. Internal faces of the first through hole, the second through hole, the third through hole and the fourth through hole form the intermediate passage.

In an exemplary embodiment, a side, far away from the first cylinder, of the first flange is provided with a first cavity, and the fourth through hole is in communication with or isolated from the first cavity.

In an exemplary embodiment, an inlet end of the intermediate passage is disposed at the bottom of the intermediate cavity.

In an exemplary embodiment, the intermediate passage includes a first flow passage section and a second flow passage section communicating with the first flow passage section. The first flow passage section is located outside of the housing assembly, and the second flow passage section is located inside the housing assembly. An end, far away from the second flow passage section, of the first flow passage section communicates with the inner cavity of the second compression part, and an end, far away from the first flow passage section, of the second flow passage section is disposed at the bottom of the intermediate cavity.

In an exemplary embodiment, the compressor further includes: a first flange disposed below the first compression part, a lower side of the first flange being provided with the first cavity; and a first cover plate disposed below the first flange, a side, facing the first flange, of the first cover plate being provided with the second cavity. The first cavity and the second cavity form the intermediate cavity together. An inlet end of the intermediate passage is disposed on a bottom wall of the second cavity.

In an exemplary embodiment, a groove is disposed on the first cover plate. The intermediate passage communicates with the second cavity through the groove.

In an exemplary embodiment, the compressor further includes the air supplement passage. The air supplement passage communicates with the intermediate passage and the inner cavity of the second compression part respectively.

In an exemplary embodiment, the second compression part includes the second cylinder. The air supplement passage is opened on the second cylinder.

According to another aspect of the disclosure, some embodiments provide an air conditioner, which includes a compressor. The compressor is the one abovementioned.

By using some embodiments of the disclosure, a bottom port of the intermediate passage is at the bottom of the intermediate cavity, so the refrigerant discharged from the first compression part squeezes the accumulated oil in the intermediate cavity into the intermediate passage, and then, the accumulated oil enters the inner cavity of the second compression part along with an air supplement refrigerant and/or a refrigerant discharged from the first compression part to be discharged. Compared to that the refrigerant discharged from the first compression part takes only the part of accumulated oil on the accumulated oil surface in the intermediate cavity to the intermediate passage, because the accumulated oil in the intermediate cavity is squeezed by the refrigerant into the intermediate passage, the speed of conveying the accumulated oil to the intermediate passage is comparatively high, and the efficiency of discharging the accumulated oil in the intermediate cavity from the intermediate cavity is comparatively high. When only the refrigerant discharged from the first compression part is used to convey the accumulated oil in the intermediate cavity to the inner cavity of the second compression part, at least a part of the intermediate passage is located outside of the housing assembly of the compressor, so when the intermediate passage located outside of the housing assembly has a failure, it is convenient to clean the intermediate passage located outside of the housing assembly or replace with a new intermediate passage.

BRIEF DESCRIPTION OF THE DRAWINGS

The accompanying drawings constituting a part of the present disclosure are used for providing further understanding of some embodiments of the disclosure. Schematic embodiments of the disclosure and description thereof are used for illustrating the disclosure and not intended to form an improper limit to the disclosure. In the accompanying drawings.

The above accompanying drawings include the following reference numbers:

10. first compression part; 11. first cylinder; 111. third through hole; 20. second compression part; 21. second cylinder; 211. first through hole; 30. intermediate cavity; 40. intermediate passage; 401. first flow passage section; 402. second flow passage section; 50. air supplement passage; 501. first passage section; 502. second passage section; 60. first flange; 61. first cavity; 62. fourth through hole; 70. first cover plate; 71. second cavity; 72. groove; 80. division plate; 81. second through hole; 90. housing assembly; 100. enthalpy adding part; 110. drainage pipe.

DETAILED DESCRIPTION OF THE EMBODIMENTS

It is to be noted that the embodiments in the present disclosure and the characteristics in the embodiments may be combined under the condition of no conflicts. The disclosure is elaborated below with reference to the accompanying drawings and embodiments.

Embodiment 1

Figure 1:
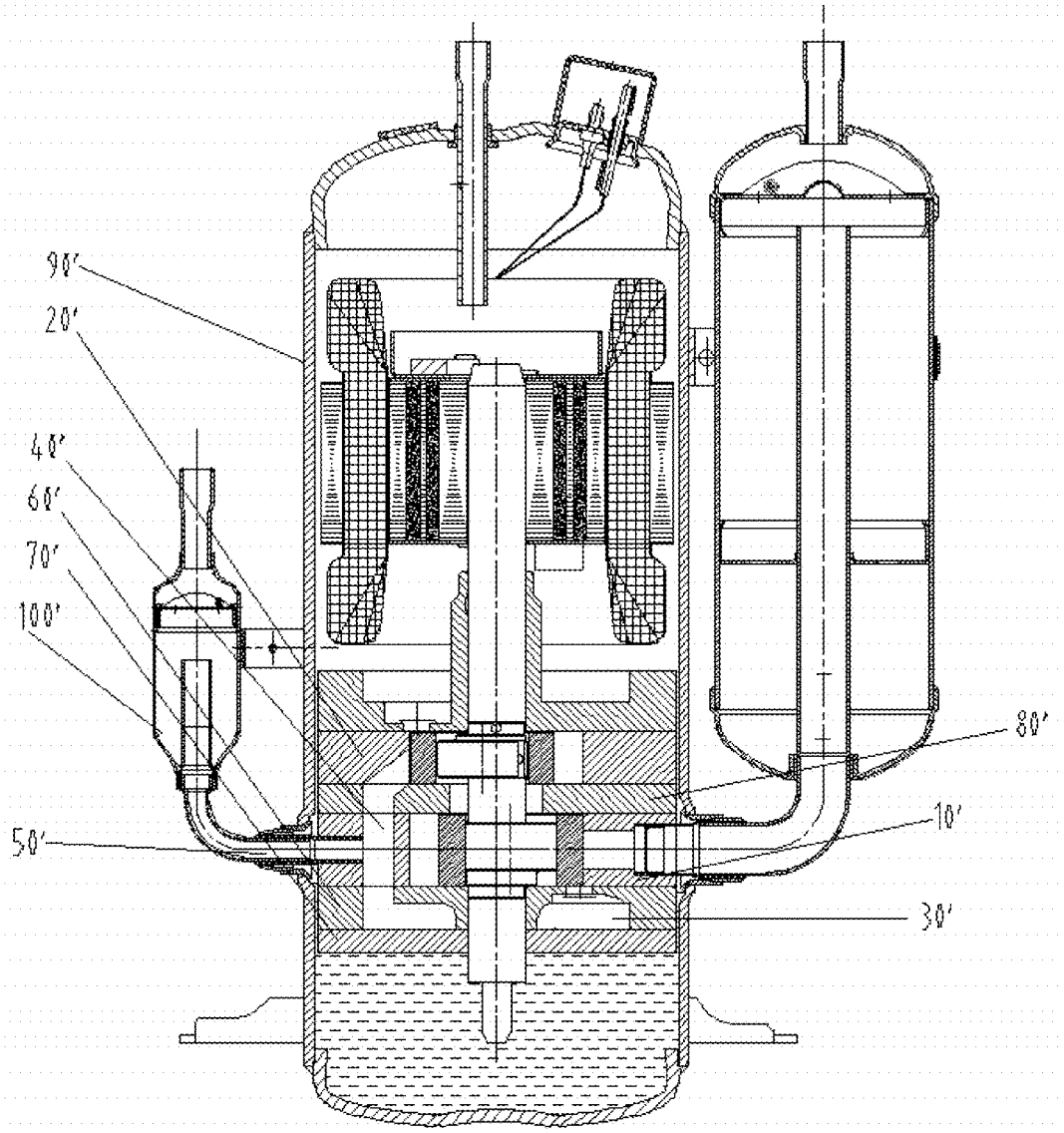
FIG. 1 illustrates a section view of a two-stage enthalpy adding compressor known to the inventors.
Figure 2:
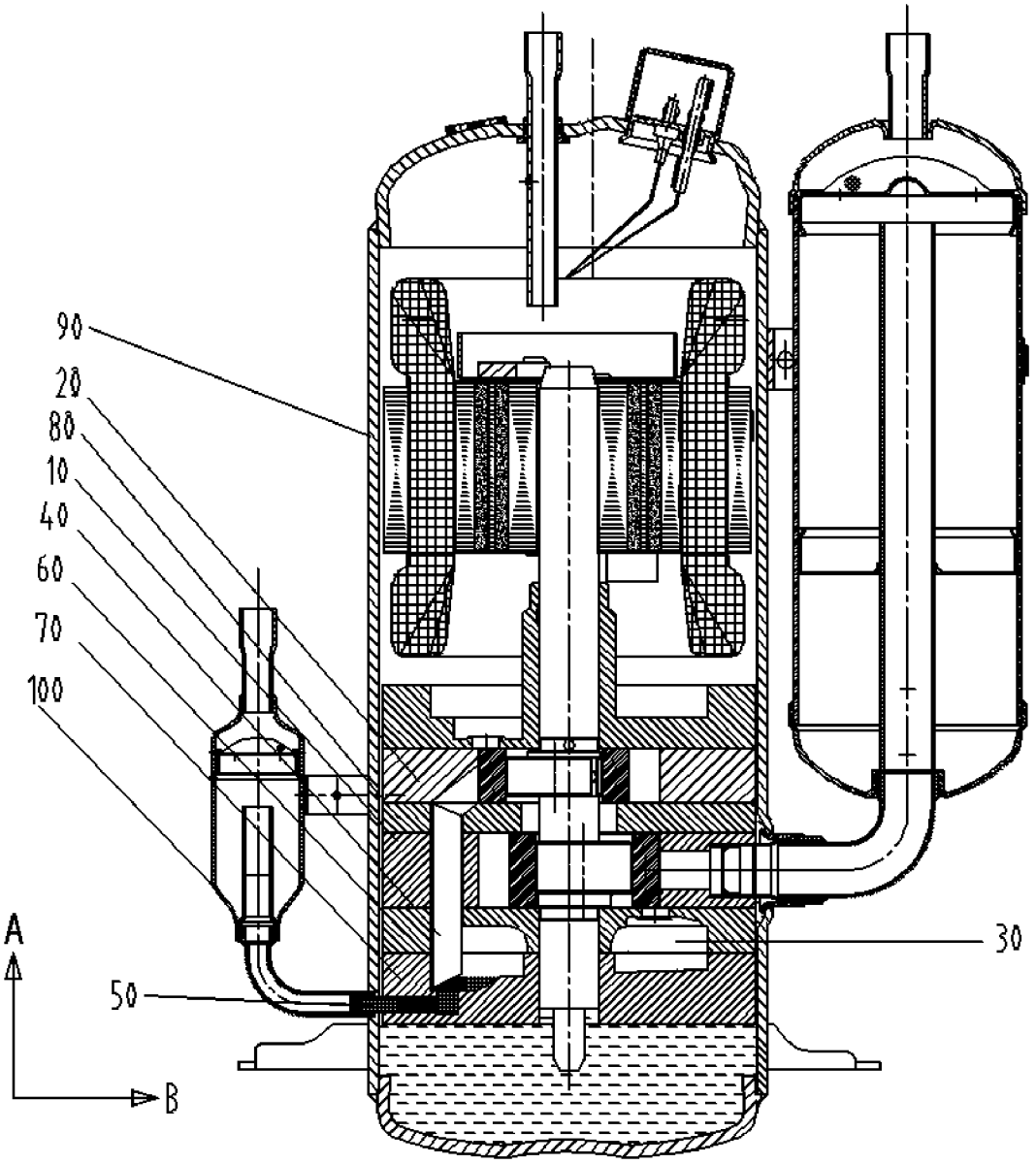
FIG. 2 illustrates a section view of a compressor according to an embodiment of the disclosure.
Figure 3:
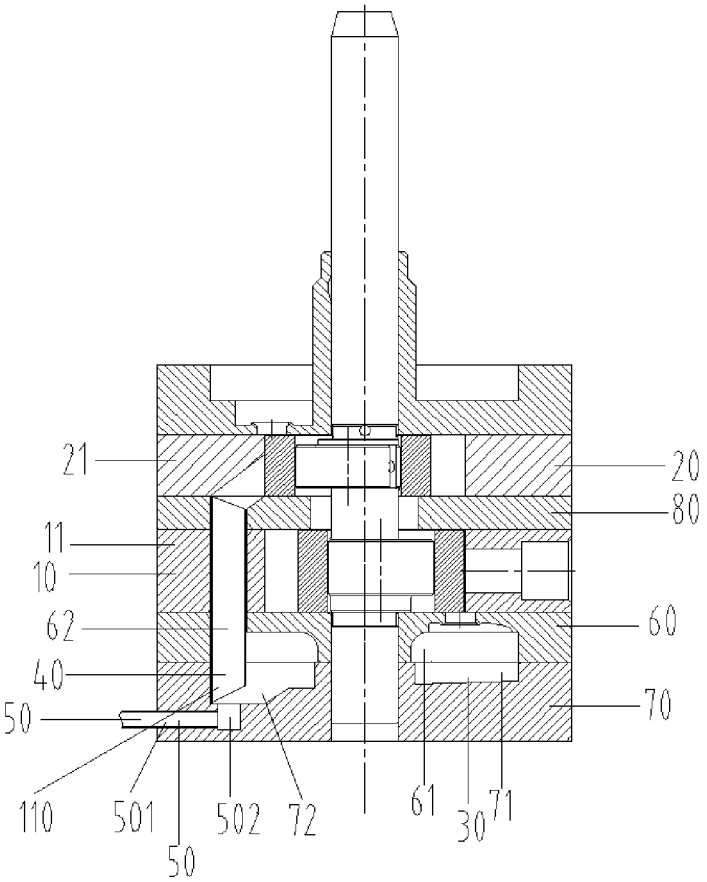
FIG. 3 illustrates a section view after a first cylinder, a second cylinder, a division plate, a first flange and other parts of the compressor in FIG. 2 are assembled.
Figure 4:
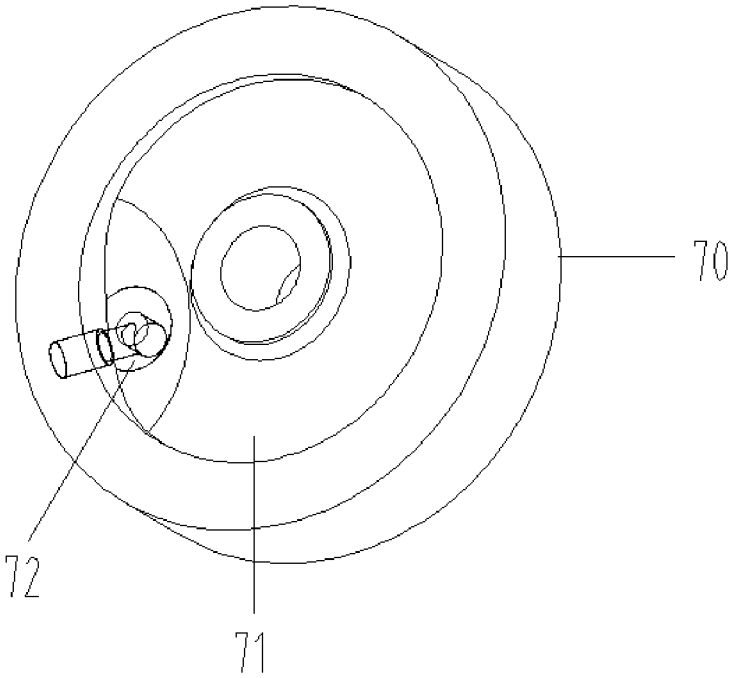
FIG. 4 illustrates a three-dimensional view of a first cover plate in FIG. 3.
Figure 5:
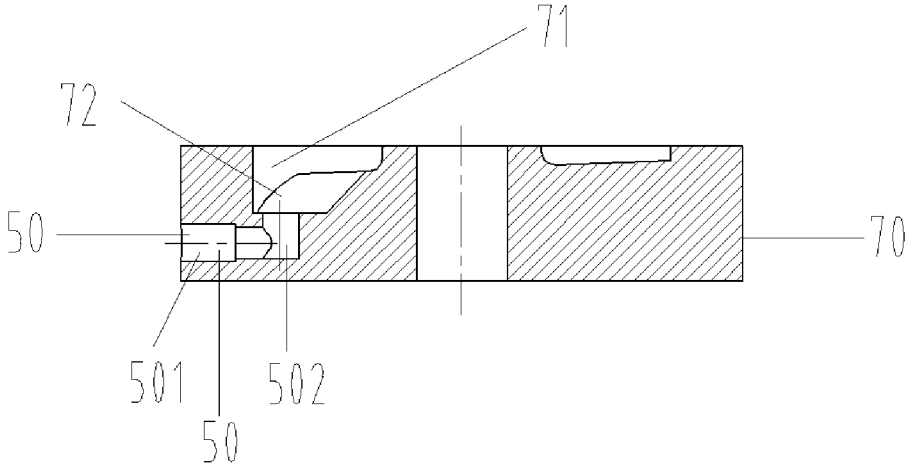
FIG. 5 illustrates a section view of the first cover plate in FIG. 3.
Figure 6:
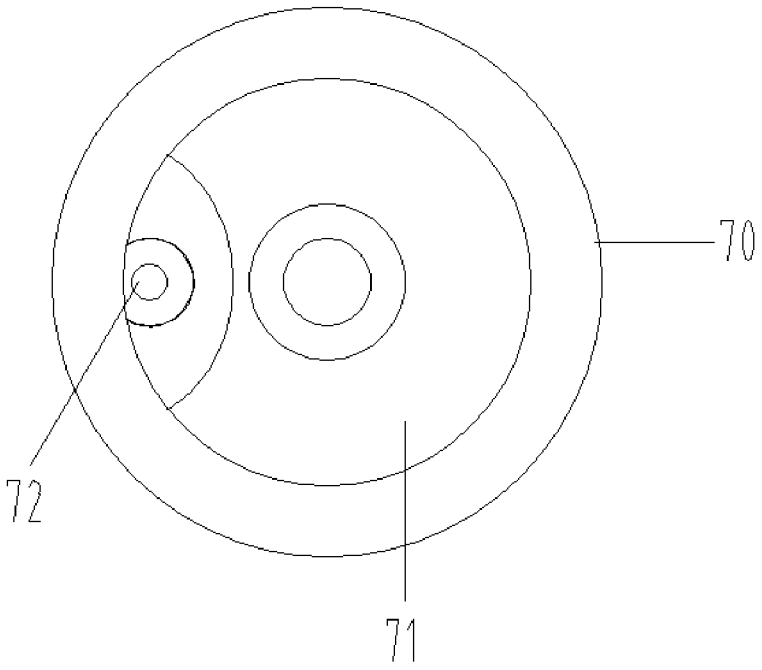
FIG. 6 illustrates a front view of the first cover plate in FIG. 3.
Figure 7:
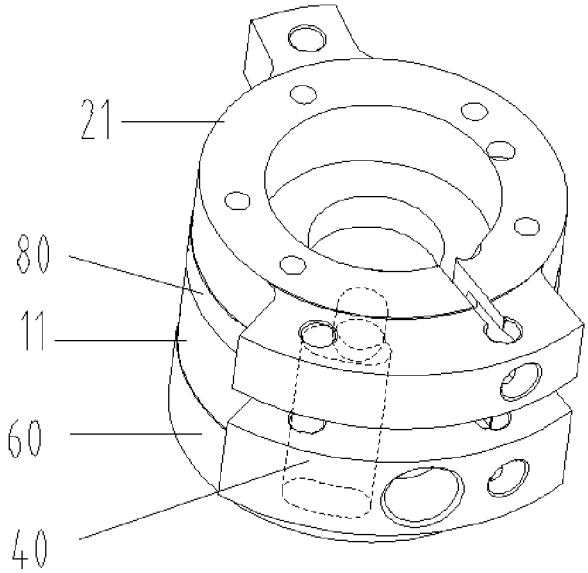
FIG. 7 illustrates a three-dimensional view of an assembly of the first cylinder, the second cylinder, the division plate and the first flange in FIG. 3.
Figure 8:
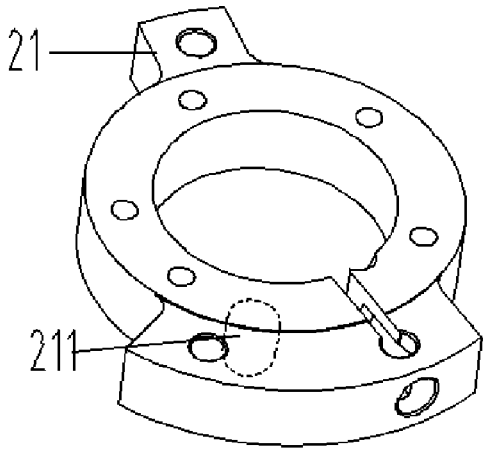
FIG. 8 illustrates a three-dimensional view of the second cylinder in FIG. 3.
Figure 9:
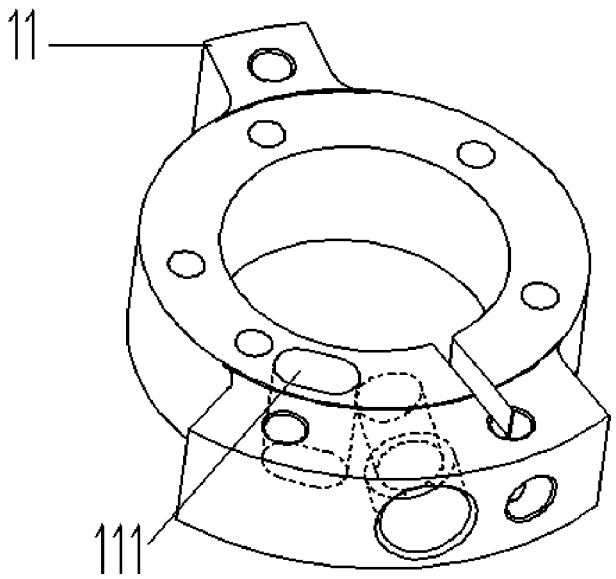
FIG. 9 illustrates a three-dimensional view of the first cylinder in FIG. 3.
Figure 10:
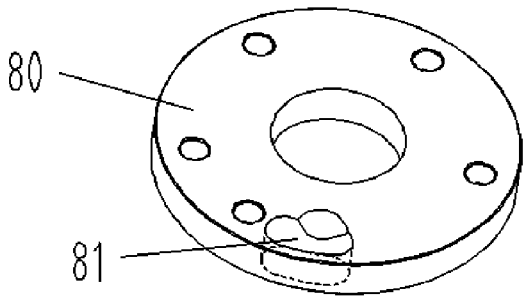
FIG. 10 illustrates a three-dimensional view of the division plate in FIG. 3.
Figure 11:
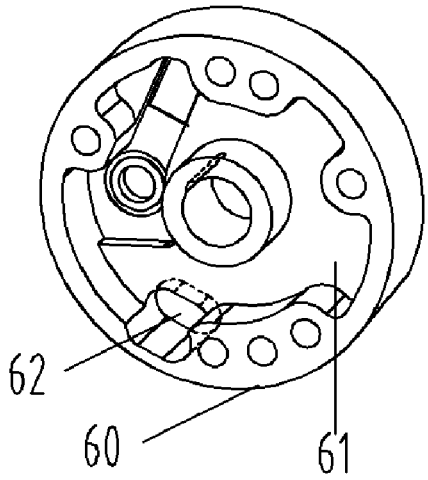
FIG. 11 illustrates a three-dimensional view of the first flange in FIG. 3.

As shown in FIG. 2 and FIG. 3, some embodiments of the present disclosure provide a compressor. The compressor includes a first compression part 10, a second compression part 20, an intermediate cavity 30, and an intermediate passage 40. Refrigerant discharged from the first compression part 10 enters the intermediate cavity 30. The intermediate passage 40 communicates with the intermediate cavity 30 and an inner cavity of the second compression part 20. A bottom port of the intermediate passage 40 is located at the bottom of the intermediate cavity 30, so as to use air supplement refrigerant and/or the refrigerant discharged from the first compression part 10 to convey accumulated oil in the intermediate cavity 30 to the inner cavity of the second compression part 20. When only the refrigerant discharged from the first compression part 10 is used to convey the accumulated oil in the intermediate cavity 30 to the inner cavity of the second compression part 20, at least a part of the intermediate passage 40 is disposed outside of a housing assembly 90 of the compressor.

The bottom port of the intermediate passage 40 is disposed at the bottom of the intermediate cavity 30, so refrigerant with pressure discharged from the first compression part 10 squeezes the accumulated oil in the intermediate cavity 30 into the intermediate passage 40 better, and then, the accumulated oil enters the inner cavity of the second compression part 20 along with the air supplement refrigerant and/or the refrigerant discharged from the first compression part 10 to be discharged. Compared to that the refrigerant discharged from the first compression part 10 takes only the part of accumulated oil on the accumulated oil surface in the intermediate cavity to the intermediate passage, because the accumulated oil in the intermediate cavity 30 is squeezed by the refrigerant into the intermediate passage 40, the speed of conveying the accumulated oil to the intermediate passage 40 is comparatively high, and the efficiency of discharging the accumulated oil in the intermediate cavity 30 from the intermediate cavity 30 is comparatively high. When only the refrigerant discharged from the first compression part 10 is used to convey the accumulated oil in the intermediate cavity 30 to the inner cavity of the second compression part 20, at least a part of the intermediate passage 40 is located outside of the housing assembly 90 of the compressor, so when the intermediate passage located outside of the housing assembly has a failure, it is convenient to clean the intermediate passage 40 located outside of the housing assembly or replace with a new intermediate passage.

In some embodiments, as shown in FIG. 2, in order to improve the speed of discharging the accumulated oil, the air supplement refrigerant and the refrigerant discharged from the first compression part 10 are used to convey the accumulated oil in the intermediate cavity 30 to the inner cavity of the second compression part 20. The accumulated oil in the intermediate cavity 30 is conveyed to the inner cavity of the second compression part 20 through the air supplement refrigerant and the refrigerant discharged from the first compression part 10, compared to that the accumulated oil in the intermediate cavity 30 is conveyed to the inner cavity of the second compression part 20 only through the refrigerant, in the embodiments, the speed of conveying the refrigerant is higher, and then the efficiency of discharging the refrigerant carrying the accumulated oil from the intermediate cavity 30 is higher, that is, the efficiency of discharging the accumulated oil in the intermediate cavity 30 from the intermediate cavity 30 is higher. In some embodiments, the compressor is a two-stage enthalpy adding compressor.

Figure 19:
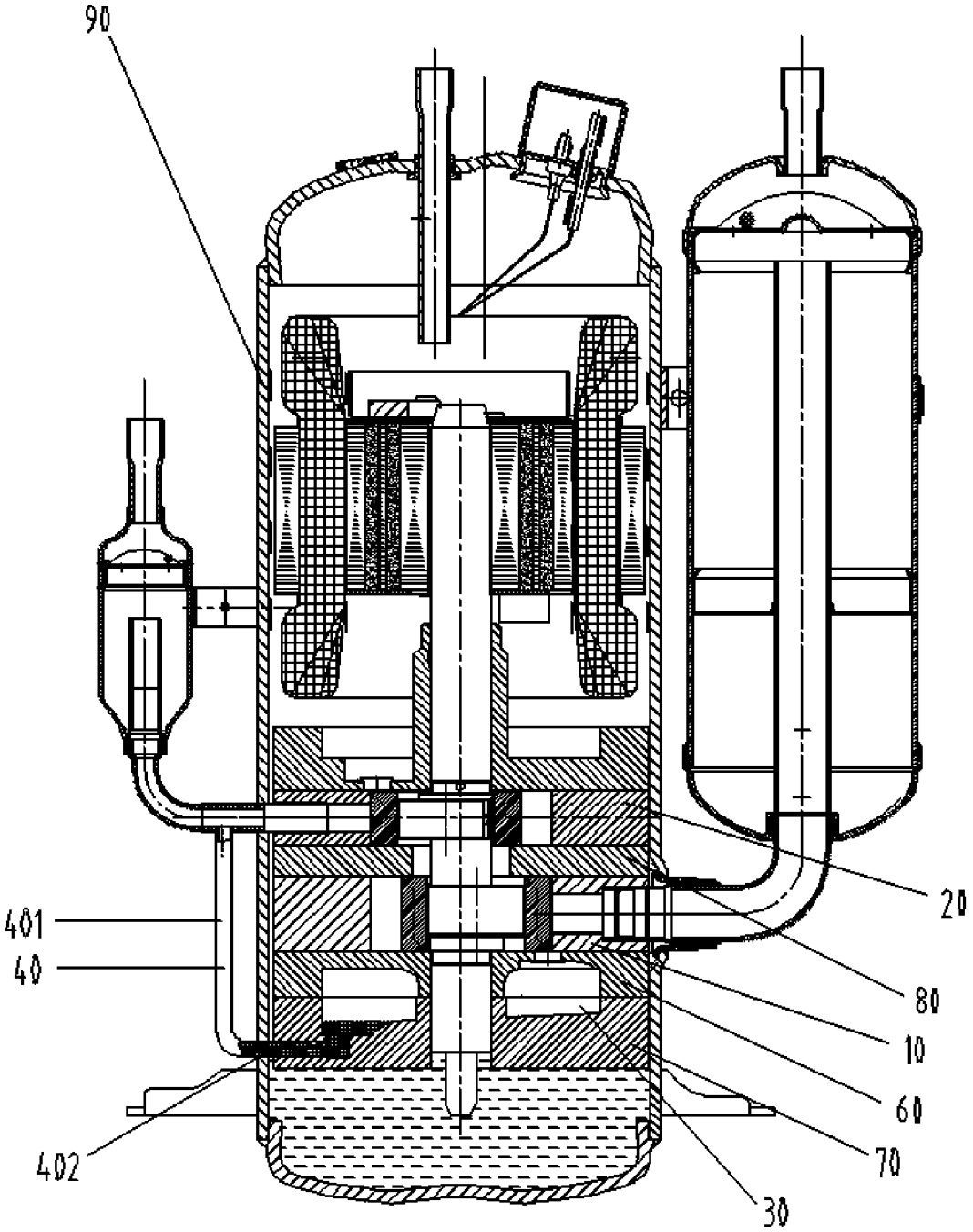
FIG. 19 shows a section view of a compressor according to embodiment 5 of the disclosure.

In some embodiments not shown in the accompanying drawings, if the compressor does not include an enthalpy adding part, when the intermediate passage 40 shown in FIG. 19 is used, that is, the bottom port of the intermediate passage 40 is at the bottom of the intermediate cavity 30, it is possible to only use the refrigerant discharged from the first compression part 10 to convey the accumulated oil in the intermediate cavity 30 to the inner cavity of the second compression part 20.

It is to be noted that in the structure shown in FIG. 19, the bottom port of the intermediate passage 40 is a port communicating with the intermediate cavity 30.

In other embodiments, the inventors only use the air supplement refrigerant to convey the accumulated oil in the intermediate cavity 30 to the inner cavity of the second compression part 20.

As shown in FIG. 2 and FIG. 3, in some embodiments, the compressor further includes an air supplement passage 50 for conveying the air supplement refrigerant. The compressor is provided with the air supplement passage 50 to feed the air supplement refrigerant to the accumulated oil in the intermediate passage 40, so as to improve the speed of conveying the accumulated oil in the intermediate cavity 30 to the inner cavity of the second compression part 20.

As shown in FIG. 2 and FIG. 3, in some embodiments, the air supplement passage 50 communicates with the intermediate cavity 30, and is disposed below the intermediate cavity 30. Because the air supplement passage 50 communicates with the intermediate cavity 30, and is disposed below the intermediate cavity 30, when the air supplement refrigerant is fed into the intermediate cavity 30 through the air supplement passage 50, the air supplement refrigerant goes through the accumulated oil from the lower part of the accumulated oil, so that the accumulated oil is atomized. Because the fluidity of the atomized accumulated oil is greater than that of the accumulated oil in liquid state, a speed of conveying the atomized accumulated oil by the refrigerant to the intermediate passage 40 is high, the efficiency of conveying the atomized accumulated oil to the inner cavity of the second compression part 20 is high, and the efficiency of discharging the atomized accumulated oil from the intermediate cavity 30 is high. That is, the air supplement passage 50 communicates with the intermediate cavity 30, and is disposed below the intermediate cavity 30, which improves the efficiency of discharging the accumulated oil from the intermediate cavity 30.

In the compressor known to the inventors, because the accumulated oil in the intermediate cavity 30' cannot be discharged in time, the accumulated oil in the intermediate cavity 30' will be absorbed instantaneously by the second compression part 20', and if the second compression part 20' absorbs excessive refrigerant oil, an oil squeezing phenomenon will appear during exhausting, so when the second compression part 20' squeezes oil, the force applied on a sliding vane increases sharply because the compressibility of liquid is less than the compressibility of gas, and then the sliding vane is ejected to separate from a roller, and they will hit each other; at the same time, the sliding vane also hit a groove bottom hole of the cylinder, which causes a hidden danger of breakage of the cylinder.

By using the technical solution of some embodiments, the accumulated oil in the intermediate cavity 30 is discharged effectively in time, so the above problem is solved.

As shown in FIG. 2, in embodiment 1, the compressor further includes the housing assembly 90. The intermediate passage 40 is located inside the housing assembly 90. The air supplement passage 50 is arranged in a radial direction of the first compression part 10. The intermediate passage 40 is arranged in an axial direction of the first compression part 10.

As shown in FIG. 2, direction A is the axial direction of the first compression part 10. Compared to that the intermediate passage 40 is located outside of the housing assembly 90, in some embodiments, because the intermediate passage 40 is located inside the housing assembly 90, an overall structure of the compressor is more compact, and the overall volume is smaller.

In some embodiments, the air supplement passage 50 is arranged in direction B.

As shown in FIG. 2 and FIG. 3, in embodiment 1, the compressor further includes the enthalpy adding part 100 communicating with the air supplement passage 50. The air supplement passage 50 includes a first passage section 501 and a second passage section 502. One end of the first passage section 501 communicates with the enthalpy adding part 100, and the other end of the first passage section 501 communicates with one end of the second passage section 502, and the other end of the second passage section 502 communicates with the intermediate cavity 30. Wherein, an included angle is formed between a centerline of the first passage section 501 and a centerline of the second passage section 502. The air supplement refrigerant of the enthalpy adding part 100 is fed into the intermediate cavity 30 after passing through the first passage section 501 and the second passage section 502, so as to convey the accumulated oil in the intermediate cavity 30 to the inner cavity of the second compression part 20.

In some embodiments, the included angle between the centerline of the first passage section 501 and the centerline of the second passage section 502 is 90 degrees. After setting like this, it is convenient to not only arrange the air supplement passage 50, but also use the air supplement refrigerant to squeeze the accumulated oil in the intermediate cavity 30 into the inner cavity of the second compression part 20.

As shown in FIG. 2 and FIG. 3, in embodiment 1, the compressor further includes a drainage structure disposed in the intermediate passage 40. One end of the drainage structure extends into the intermediate cavity 30.

Because the refrigerant is subjected to small resistance when flowing in the drainage structure, setting the drainage structure in the intermediate passage 40 in the embodiment improves a flowing speed of the refrigerant, and improves the efficiency of discharging the accumulated oil carrying the refrigerant from the intermediate cavity. Therefore, the efficiency of discharging the accumulated oil in the intermediate cavity 30 is comparatively high.

In some embodiments, the drainage structure is a drainage pipe 110. The end, facing the intermediate cavity 30, of the drainage pipe 110 is set titled. Because one end of the drainage pipe 110 is set titled, a part of a titled end of the drainage pipe is disposed below a level of the accumulated oil in the intermediate cavity 30, and the refrigerant carrying the accumulated oil in the intermediate cavity 30 enters the drainage pipe 110 from the titled end of the drainage pipe, and then flows to the inner cavity of the second compression part 20. Compared to that all of the end of the drainage pipe extends below the level of the accumulated oil, the embodiments of the present disclosure are more convenient for the refrigerant to squeeze the oil in the intermediate cavity 30 into the drainage pipe, thus inhalation resistance of the second compression part 20 is reduced.

As shown in FIG. 2 and FIG. 3, in embodiment 1, the compressor further includes a first flange 60 and a first cover plate 70. The first flange 60 is disposed below the first compression part 10, and a lower side of the first flange 60 is provided with a first cavity 61. The first cover plate 70 is disposed below the first flange 60, and a side, facing the first flange 60, of the first cover plate 70 is provided with a second cavity 71. The first cavity 61 and the second cavity 71 form the intermediate cavity 30 together. An air supplement opening of the air supplement passage 50 is disposed on a bottom wall of the second cavity 71.

Compared to the intermediate cavity 30 formed by only the first cavity 61 of the first flange 60 known to the inventors, in some embodiments, because the first cavity 61 of the first flange 60 and the second cavity 71 of the first cover plate 70 form the intermediate cavity 30 together, the volume of the intermediate cavity 30 is larger, and then in the intermediate cavity 30, the refrigerant and the accumulated oil have a larger space to mix together, so a mixing volume of the refrigerant and the accumulated oil is larger, and more accumulated oil is conveyed to the inner cavity of the second compression part 20.

As shown in FIG. 2 to FIG. 6, in the disclosure, the compressor includes a groove 72 disposed on the first cover plate 70, and the air supplement passage 50 communicates with the second cavity 71 through the groove 72. In the embodiments, because there is also the groove 72 disposed on the first cover plate 70, the accumulated oil in the intermediate cavity 30 will concentrate in the groove 72, that is, a thickness size of the accumulated oil in the groove 72 is greater than a thickness size of the accumulated oil at other positions in the intermediate cavity 30; in addition, because the air supplement passage 50 communicates with the second cavity 71 through the groove 72, when the air supplement refrigerant is fed into the intermediate cavity 30, the thickness size of the accumulated oil through which the air supplement refrigerant goes is larger, the degree of atomizing of the accumulated oil is larger, and then the efficiency of discharging the accumulated oil from the intermediate cavity 30 is comparatively high.

Figure 12:
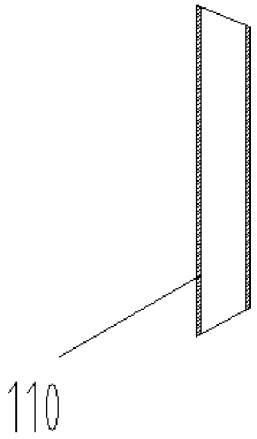
FIG. 12 illustrates a section view of a drainage pipe in FIG. 2.

As shown in FIG. 2, FIG. 3 and FIG. 12, in embodiment 1, the compressor further includes the drainage pipe 110 disposed in the intermediate passage 40. An end, facing the second cavity 71, of the drainage pipe 110 is set tilted. Because one end of the drainage pipe 110 is set titled, a part of the titled end of the drainage pipe extends into the groove 72, and the refrigerant carrying the accumulated oil in the intermediate cavity 30 enters the drainage pipe from the part, above the groove 72, of the titled end of the drainage pipe, and then flows to the inner cavity of the second compression part 20. Compared to that all the end of the drainage pipe extends into the groove 72, the refrigerant in the intermediate cavity 30 needs to squeeze the oil in the groove 72 into the drainage pipe. The embodiments reduce the inhalation resistance of the second compression part 20, which is good for the second compression part 20 to inhale.

As shown in FIG. 2 to FIG. 11, in embodiment 1, the first compression part 10 includes a first cylinder 11, the second compression part 20 includes a second cylinder 21, and the first cylinder 11 and the second cylinder 21 are superposed. The compressor further includes a division plate 80 disposed between the first cylinder 11 and the second cylinder 21 and a first flange 60 disposed below the first cylinder 11. The intermediate passage 40 is formed on an assembly consisting of the first cylinder 11, the second cylinder 21, the division plate 80 and the first flange 60.

By using the embodiments, the intermediate passage 40 is arranged inside the housing assembly 90, so the overall structure of the compressor is more compactor, and the volume of the compressor is smaller.

As shown in FIG. 2 to FIG. 11, in embodiment 1, the compressor includes: a first through hole 211 arranged on the second cylinder 21; a second through hole 81 communicated with the first through hole 211 and arranged on the division plate 80; a third through hole 111 communicated with the second through hole 81 and arranged on the first cylinder 11; and a fourth through hole 62 communicated with the third through hole 111 and arranged on the first flange 60. Internal faces of the first through hole 211, the second through hole 81, the third through hole 111 and the fourth through hole 62 form the intermediate passage 40.

The above way of setting the intermediate passage 40 is comparatively simple and easy to process.

The flow process of the refrigerant and the accumulated oil in embodiment 1 is as follows: in the technical solution, the air supplement opening of the air supplement passage 50 is disposed at the bottom of the groove 72 (referring to FIG. 3 to FIG. 5), the gas inflowing through the enthalpy adding part (a second loop) outflows from the bottom of the groove 72, enters the intermediate cavity 30 of primary exhaust, and then is inhaled into the second cylinder 21 through the drainage pipe 110. The groove 72 at the bottom of the intermediate cavity 30 has an effect of accommodating the accumulated oil in the intermediate cavity. The accumulated oil in the intermediate cavity 30 flows into the groove 72, enters the drainage pipe 110 along with the air supplement refrigerant and the refrigerant flowing through the intermediate cavity 30, and is inhaled into the second cylinder 21 through the intermediate passage 40 (referring to FIG. 2). The way of discharging the accumulated oil in embodiment 1 is as follows: when outflowing from the accumulated oil in the groove 72, intermediate air supplement air (namely the air supplement refrigerant) carries the accumulated oil into the second cylinder 21; at the same time, when bursting into the groove 72, intermediate air supplement gas flow causes the occurrence of disturbance or bubble in the accumulated oil to generate an atomizing effect, which makes oil drops occur, and then the second cylinder 21 takes the oil drops away when inhaling (referring to FIG. 2). The intermediate passage 40 is arranged on a pump and arranged in the drainage pipe 110, and an inlet at a lower end of the drainage pipe 110 is set wedge-shaped and extends into the bottom of the groove 72 (referring to FIG. 3 and FIG. 12; in such a manner, the accumulated oil is led and taken away on one hand, and the resistance that the gas in the intermediate cavity 30 outflows to the second cylinder 21 to be inhaled is reduced on the other hand.

Embodiment 2

Figure 13:
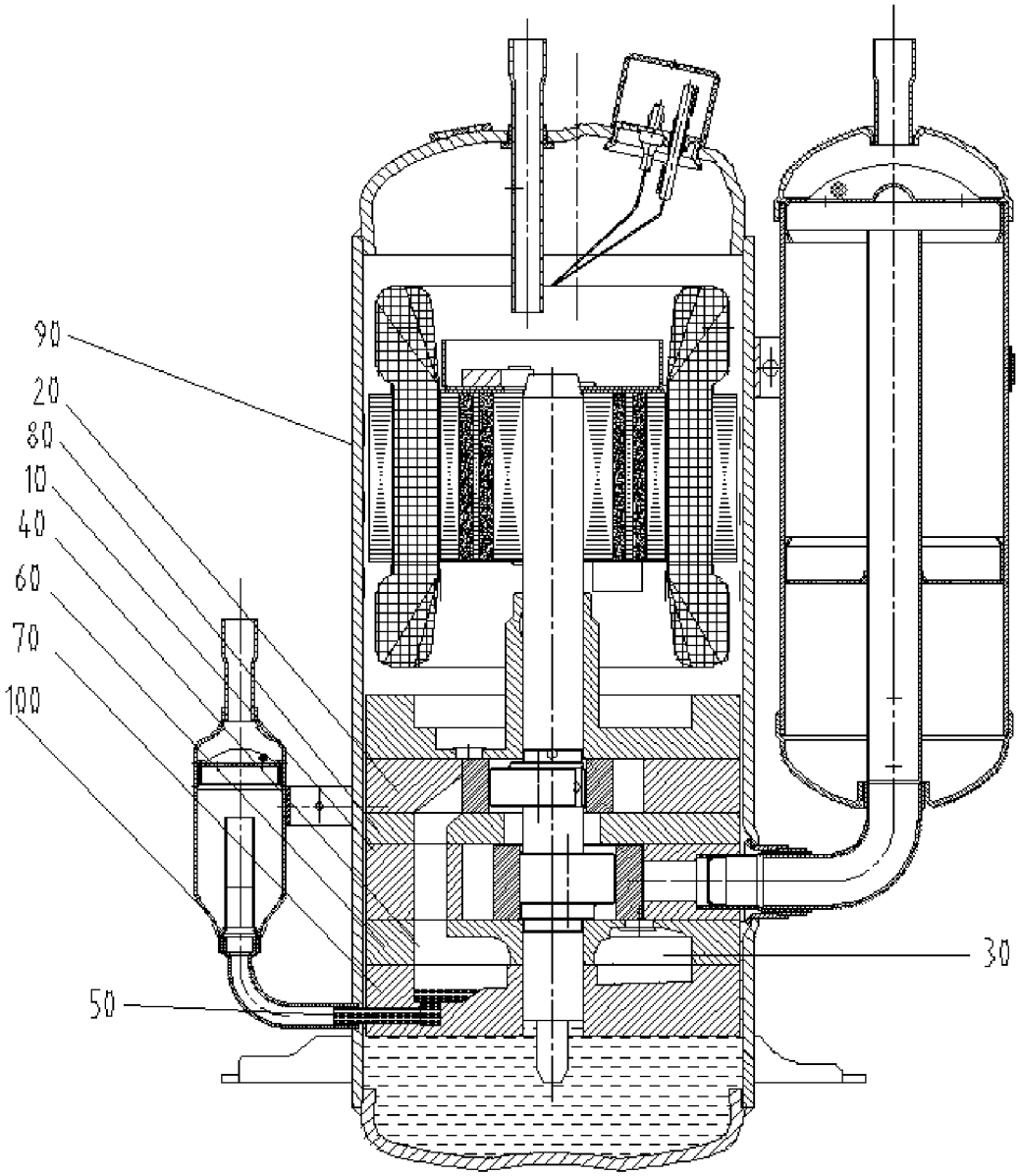
FIG. 13 illustrates a section view of a compressor according to embodiment 2 of the disclosure.
Figure 14:
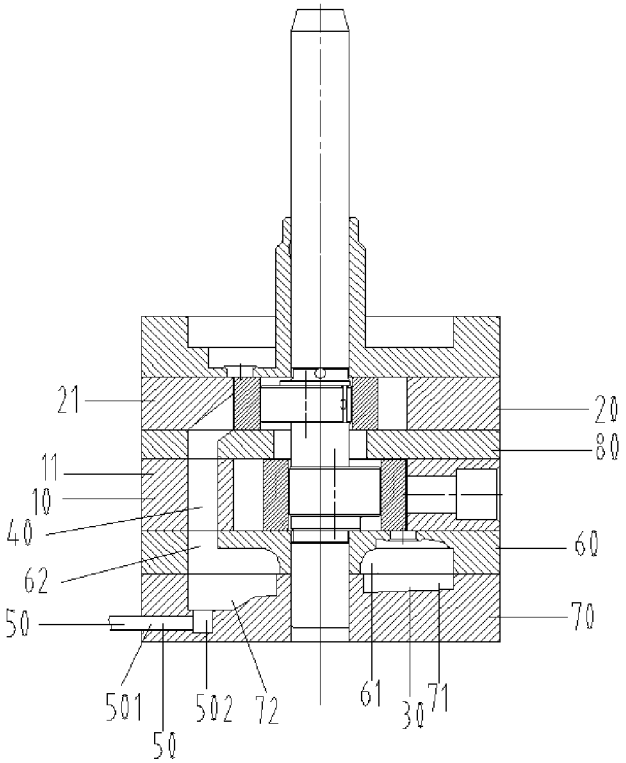
FIG. 14 illustrates a section view after the first cylinder, the second cylinder, the division plate, the first flange and other parts of the compressor in FIG. 13 are assembled.

As shown in FIG. 13 and FIG. 14, in embodiment 2, a difference between the structure of the first flange 60 and the structure in embodiment 1 is that: a side, far away from the first cylinder 11, of the first flange 60 is provided with the first cavity 61, and the fourth through hole 62 communicates with the first cavity 61.

In addition, a difference between embodiment 2 and embodiment 1 is that: there is no drainage pipe arranged in the intermediate passage 40 of the embodiment 2. Other settings of embodiment 2 are the same as embodiment 1, and will not be repeated here.

Embodiment 3

Figure 15:
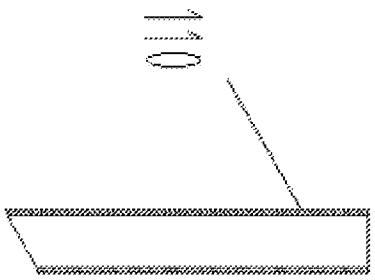
FIG. 15 shows a section view of a drainage pipe of a compressor according to embodiment 3 of the disclosure.

On the basis of embodiment 1, as shown in FIG. 15, in embodiment 3, the titled shape of the end, facing the first cover plate 70, of the drainage pipe is changed to a flat opening shape, and an end face of the flat opening is flush with an end face, far away from the first compression part 10, of the first flange 60. The effect of discharging the accumulated oil in the intermediate cavity 30 of embodiment 3 is equal to the effect of discharging the accumulated oil in the intermediate cavity 30 of embodiment 2.

Embodiment 4

Figure 16:
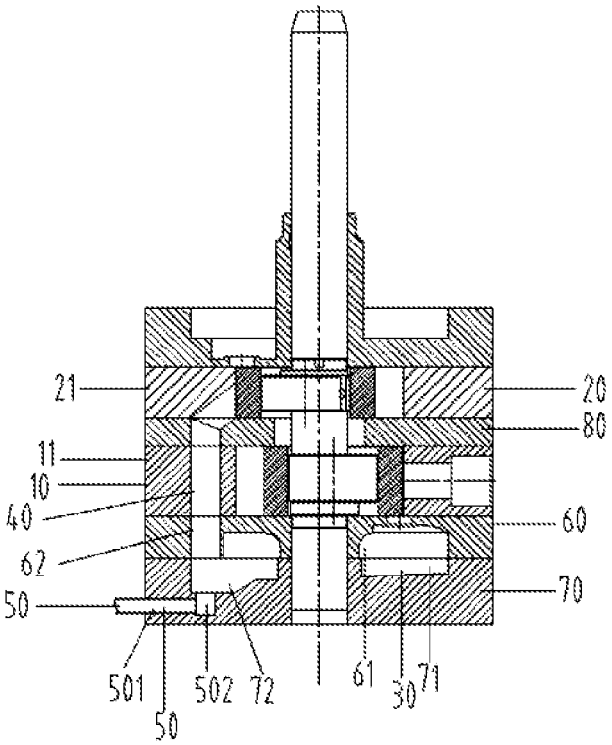
FIG. 16 shows a section view after the first cylinder, the second cylinder, the division plate, the first flange and other parts of a compressor according to embodiment 4 of the disclosure.
Figure 17:
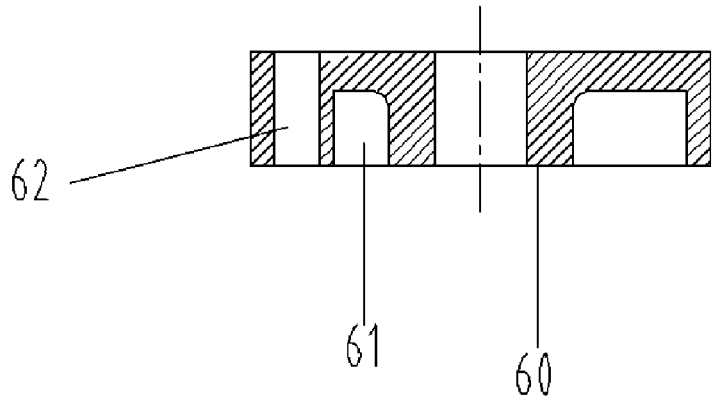
FIG. 17 shows a section view of the first flange in FIG. 16.
Figure 18:
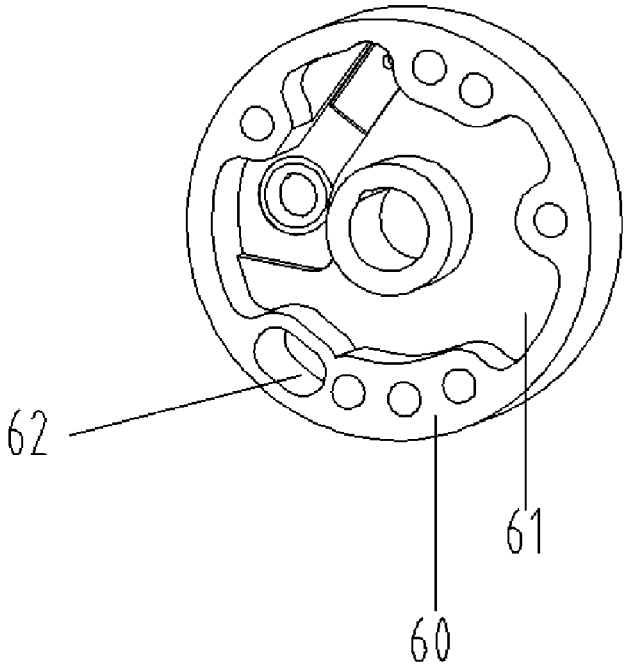
FIG. 18 shows a three-dimensional view of the first flange in FIG. 16.

As shown in FIG. 16. FIG. 17 and FIG. 18, in embodiment 4, the side, far away from the first cylinder 11, of the first flange 60 is provided with the first cavity 61, and the fourth through hole 62 is isolated from the first cavity 61. A difference between embodiment 4 and embodiment 1 is that: there is no drainage pipe disposed in the intermediate passage 40 of embodiment 4, and the fourth through hole 62 of the first flange 60 is isolated from the first cavity 61. Other settings of embodiment 4 are the same as embodiment 1, and will not be repeated here.

Compared to embodiment 1, in the technical solution of embodiment 4, because the fourth through hole 62 of the first flange 60 is isolated from the first cavity 61, the internal faces of the first through hole 211, the second through hole 81, the third through hole 111 and the fourth through hole 62 form the intermediate passage 40 extending into the groove 72, and then there is no need to arrange the drainage pipe in the intermediate passage while improving the efficiency of discharging the accumulated oil in the intermediate cavity 30 from the intermediate cavity 30, thus the structure is simple.

Embodiment 5

Figure 20:
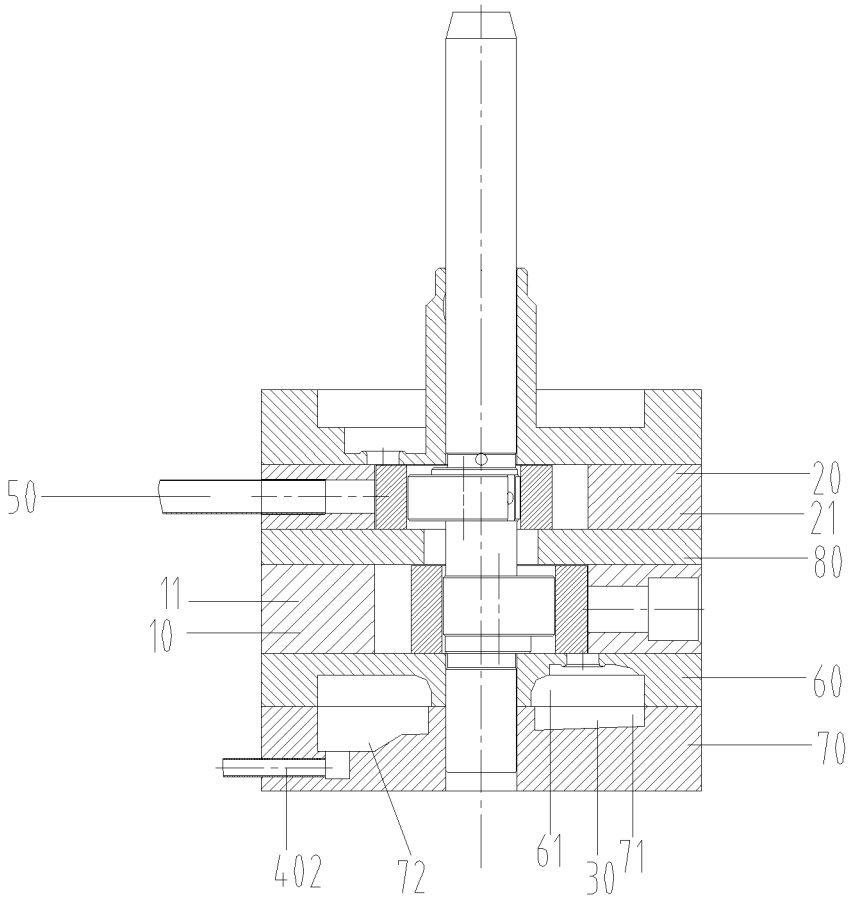
FIG. 20 shows a section view after the first cylinder, the second cylinder, the division plate, the first flange and other parts of the compressor in FIG. 19 are assembled.

As shown in FIG. 19 and FIG. 20, a difference between embodiment 5 and embodiment 1 is that: a part of the intermediate passage 40 is located outside of the housing assembly 90, and the inlet end of the intermediate passage 40 is disposed at the bottom of the intermediate cavity 30.

In some embodiments, a part of the intermediate passage is arranged outside of the housing assembly 90, which is convenient to clean and replace the intermediate passage. In the embodiments, because the inlet end of the intermediate passage 40 is disposed at the bottom of the intermediate cavity 30, the refrigerant discharged from the first compression part 10 squeezes the accumulated oil in the intermediate cavity 30 into the inlet of the intermediate passage 40, and then conveys the accumulated oil to the inner cavity of the second compression part 20 through the intermediate passage 40. Therefore, the solution discharges the accumulated oil in the intermediate cavity 30 effectively.

As shown in FIG. 19 and FIG. 20, in some embodiments, the intermediate passage 40 includes a first flow passage section 401 and a second flow passage section 402 communicating with the first flow passage section 401. The first flow passage section 401 is located outside of the housing assembly 90, and the second flow passage section 402 is located inside the housing assembly 90. An end, far away from the second flow passage section 402, of the first flow passage section 401 communicates with the inner cavity of the second compression part 20, and an end, far away from the first flow passage section 401, of the second flow passage section 402 is disposed at the bottom of the intermediate cavity 30. In the embodiment, because the first flow passage section 401 is arranged outside of the housing assembly 90, when the first flow passage section 401 is blocked or damaged, it is convenient to replace or clean the first flow passage section 401 without the need of disassembling the housing assembly 90.

As shown in FIG. 19 and FIG. 20, in some embodiments, the compressor further includes the first flange 60 and the first cover plate 70. The first flange 60 is disposed below the first compression part 10, and a lower side of the first flange 60 is provided with the first cavity 61. The first cover plate 70 is arranged below the first flange 60, and a side, facing the first flange 60, of the first cover plate 70 is provided with the second cavity 71. The first cavity 61 and the second cavity 71 form the intermediate cavity 30 together. Another difference between embodiment 5 and embodiment 1 is that: the inlet end of the intermediate passage 40 is disposed on a bottom wall of the second cavity 71.

As shown in FIG. 19 and FIG. 20, in embodiment 5, there is also the groove 72 arranged on the first cover plate 70, and the intermediate passage 40 communicates with the second cavity 71 through the groove 72. Because there is the groove 72 arranged on the first cover plate 70, the accumulated oil in the intermediate cavity 30 concentrates in the groove 72. The refrigerant discharged from the first compression part 10 squeezes, at the groove 72, the accumulated oil into the inlet of the intermediate passage 40. In the process, the accumulated oil in the intermediate cavity automatically concentrates in the groove 72, so as to be squeezed into the inlet of the intermediate passage 40; by repeating this cycle, the speed of squeezing the accumulated oil in the intermediate cavity 30 into the intermediate passage 40 is improved, and then the efficiency of discharging the accumulated oil in the intermediate cavity is improved.

As shown in FIG. 19 and FIG. 20, in embodiment 5, the compressor further includes the air supplement passage 50. The air supplement passage 50 communicates with the intermediate passage 40 and the inner cavity of the second compression part 20 respectively. In the embodiment, the air supplement passage 50 communicates with the end, far away from the second flow passage section 402, of the first flow passage section 401, and after converging with the refrigerant discharged from the first flow passage section 401, the air supplement refrigerant is conveyed to the inner cavity of the second compression part 20, so as to improve the speed of conveying the accumulated oil in the intermediate cavity 30 to the inner cavity of the second compression part 20.

As shown in FIG. 19 and FIG. 20, the difference between embodiment 5 and embodiment 1 is that the air supplement passage 50 is disposed on the second cylinder 21. Compared to that the air supplement passage 50 is arranged at other position, the air supplement passage 50 in the embodiment is shorter, the speed loss of the refrigerant in the air supplement passage 50 is minimum, that is, the refrigerant carrying the accumulated oil is conveyed to the inner cavity of the second compression part 20 at a highest speed, thereby improving the efficiency of discharging the accumulated oil from the intermediate cavity.

The process of discharging the accumulated oil in the intermediate cavity 30 of the compressor in FIG. 19 and FIG. 20 is described below.

When being discharged through the bottom of the groove 72, the refrigerant in the intermediate cavity 30 will enter, carrying the accumulated oil, the first flow passage section 401 and the second flow passage section 402 of the intermediate passage 40, or the accumulated oil is preferentially discharged in the intermediate passage, and then is inhaled in the second cylinder 21 after being mixed with the air supplement refrigerant provided by the enthalpy adding part, thereby preventing the accumulated oil in the intermediate cavity from accumulating. The second flow passage section 402 of the intermediate passage 40 is disposed outside of a housing of the compressor in a pipeline mode, and communicates with an enthalpy adding air supplement pipeline.

Some embodiments of the present disclosure also provide an air conditioner, which includes a compressor. The compressor is the one abovementioned.

The embodiments of the present disclosure have the following technical effects.

Adopting the compressor of the disclosure prevents the second compression part 20 from squeezing oil, enable the compressor to operate steadily, and prevent the sliding vane of the second compression part 20 from hitting the roller or the groove bottom hole, thereby improving the operating reliability of the compressor.

Figure 21:
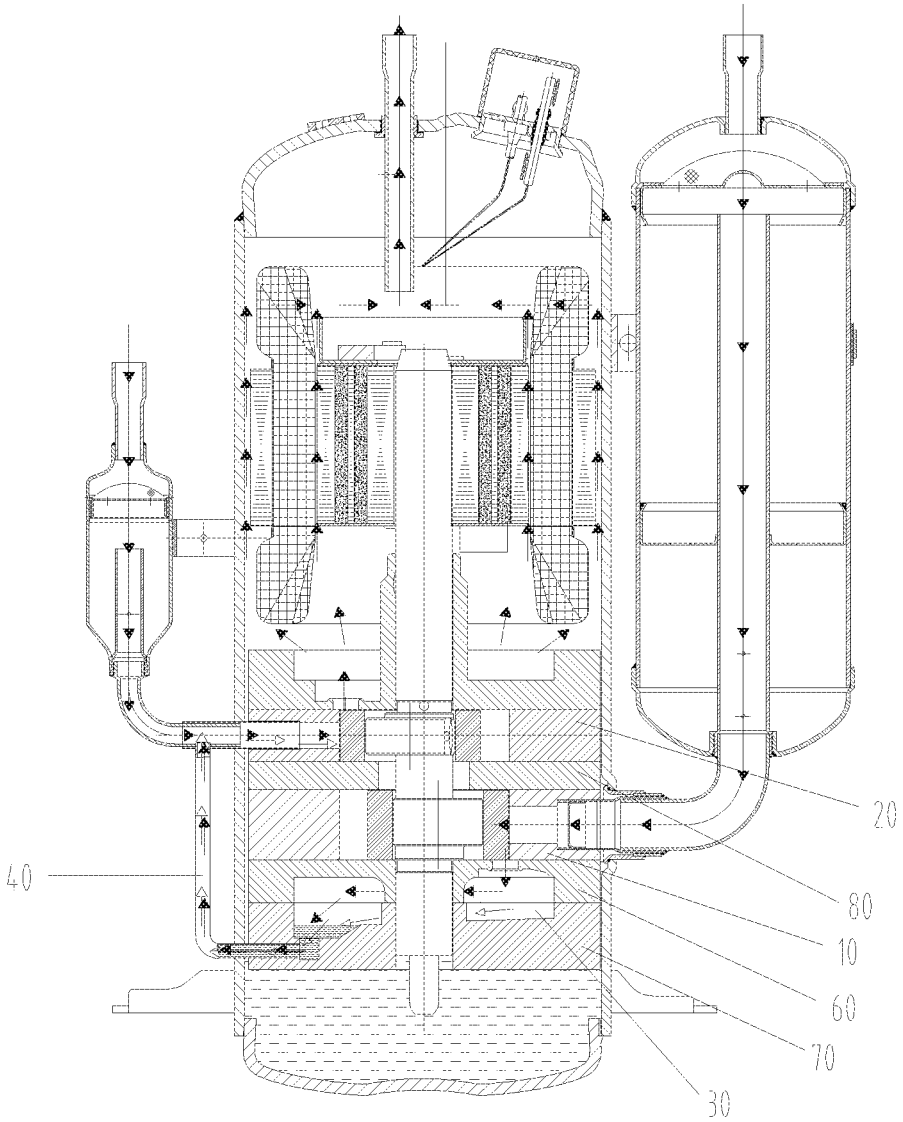
FIG. 21 shows a schematic diagram of the flow of refrigerant and lubricating oil in the compressor in FIG. 19.

Wherein, FIG. 21 shows a schematic diagram of the flow of refrigerant and lubricating oil of the compressor in FIG. 19. As shown in FIG. 21, solid arrows represent a flow direction of the refrigerant, and hollow arrows represent a flow direction of the lubricating oil. As shown in FIG. 21, low-pressure refrigerant inhaled from an automatically inhaling opening enters the intermediate cavity 30 through the first compression part 10, and then enters the second cylinder 21 through the intermediate passage 40 after being mixed with medium pressure refrigerant provided by the enthalpy adding part 100. The mixed gas is discharged through an exhaust pipe after passing through the second cylinder 21.

Figure 22:
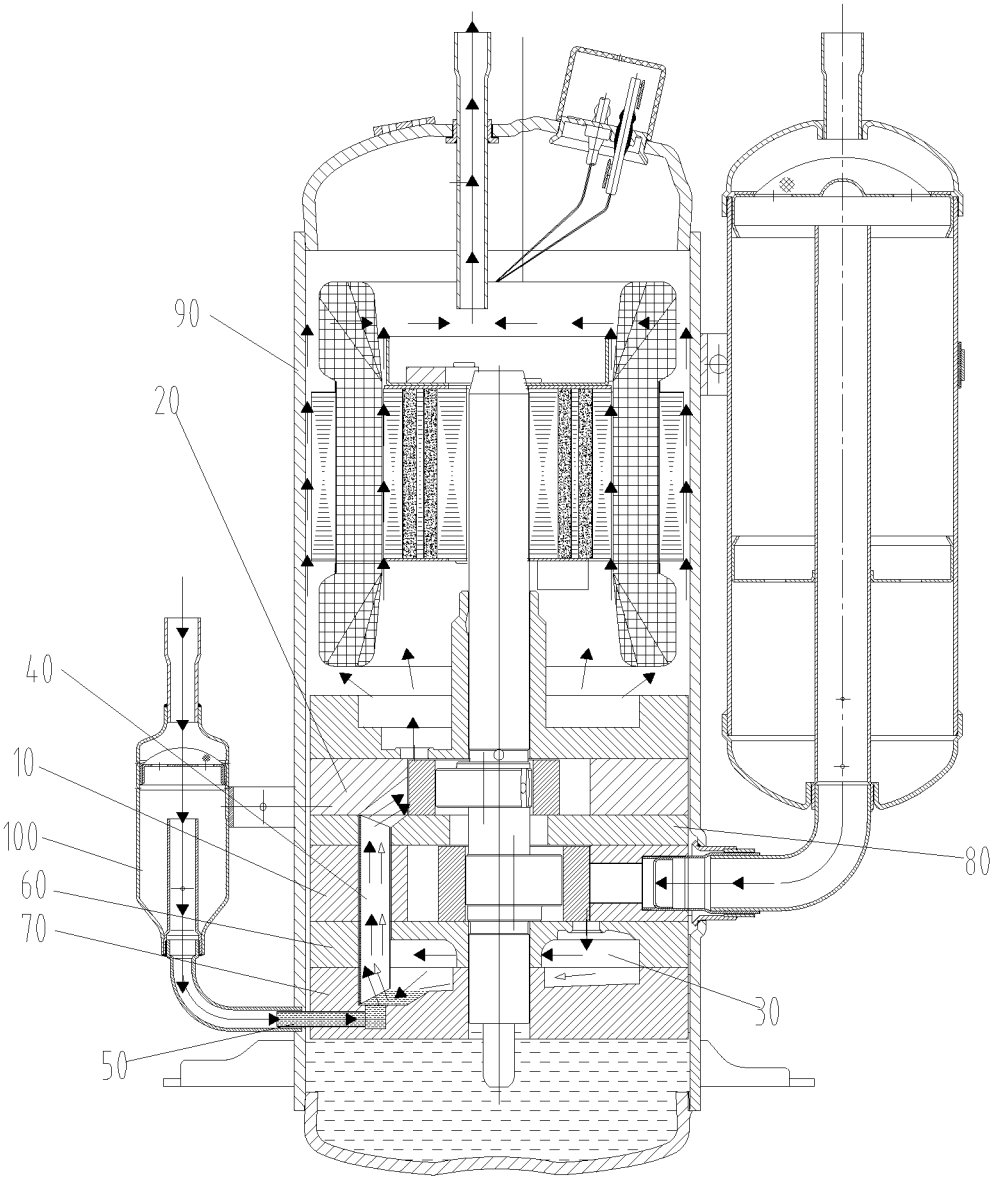
FIG. 22 shows a schematic diagram of the flow of refrigerant and lubricating oil in the compressor in FIG. 2.

FIG. 22 shows a schematic diagram of the flow of refrigerant and lubricating oil of the compressor in FIG. 2. As shown in FIG. 22, the solid arrows represent the flow direction of the refrigerant, and the hollow arrows represent the flow direction of the lubricating oil.

It can be seen from above description that the above embodiments of the disclosure achieve the following technical effects: the bottom port of the intermediate passage is at the bottom of the intermediate cavity, so the refrigerant discharged from the first compression part squeezes the accumulated oil in the intermediate cavity into the intermediate passage, and then, the accumulated oil enters the inner cavity of the second compression part along with the air supplement refrigerant and/or the refrigerant discharged from the first compression part to be discharged. Compared with that the refrigerant discharged from the first compression part takes only a part of accumulated oil on the accumulated oil surface in the intermediate cavity to the intermediate passage, because the accumulated oil in the intermediate cavity is squeezed by the refrigerant into the intermediate passage, the speed of conveying the accumulated oil to the intermediate passage is comparatively high, and the efficiency of discharging the accumulated oil in the intermediate cavity from the intermediate cavity is comparatively high. When only the refrigerant discharged from the first compression part is used to convey the accumulated oil in the intermediate cavity to the inner cavity of the second compression part, at least a part of the intermediate passage is located outside of the housing assembly of the compressor, so when the intermediate passage located outside of the housing assembly has a failure, it is convenient to clean the intermediate passage located outside of the housing assembly or replace with a new intermediate passage.

The above is only some embodiments of the disclosure and not intended to limit the disclosure; for those skilled in the art, the disclosure may have various modifications and changes. Any modifications, equivalent replacements, improvements and the like within the spirit and principle of the disclosure should fall within the protection scope of the claims of the disclosure.

What is claimed:

1. A compressor having an intermediate passage capable of conveying accumulated oil to a second compression part, comprising:

a first compression part;

a second compression part;

an intermediate cavity, refrigerant discharged from the first compression part entering the intermediate cavity;

an intermediate passage, the intermediate passage communicating with the intermediate cavity and an inner cavity of the second compression part; a bottom port of the intermediate passage is located at a bottom of the intermediate cavity; and an air supplement passage for conveying an air supplement refrigerant, the air supplement passage is communicated with the intermediate cavity, and is disposed below the intermediate cavity, so as to use the air supplement refrigerant and the refrigerant discharged from the first compression part or only the air supplement refrigerant to convey accumulated oil in the intermediate cavity to the inner cavity of the second compression part.

2. The compressor as claimed in claim 1, further comprising: the housing assembly; the intermediate passage is disposed inside the housing assembly; the air supplement passage is arranged in a radial direction of the first compression part; and the intermediate passage is arranged in an axial direction of the first compression part.

3. The compressor as claimed in claim 2, further comprising: an enthalpy adding part communicating with the air supplement passage; the air supplement passage comprises:

a first passage section; and a second passage section, wherein one end of the first passage section communicates with the enthalpy adding part, the other end of the first passage section communicates with one end of the second passage section, and the other end of the second passage section communicates with the intermediate cavity, wherein, an included angle is provided between a centerline of the first passage section and a centerline of the second passage section.

4. The compressor as claimed in claim 2, further comprising: a drainage structure disposed in the intermediate passage; one end of the drainage structure extends into the intermediate cavity.

5. The compressor as claimed in claim 1, further comprising:

a first flange disposed below the first compression part, a lower side of the first flange being provided with a first cavity;

a first cover plate disposed below the first flange, a side, facing the first flange, of the first cover plate being provided with a second cavity; the first cavity and the second cavity form the intermediate cavity together; and an air supplement opening of the air supplement passage is disposed on a bottom wall of the second cavity.

6. The compressor as claimed in claim 5, wherein the compressor comprises a groove disposed on the first cover plate; the air supplement passage communicates with the second cavity through the groove.

7. The compressor as claimed in claim 5, further comprising: a drainage pipe disposed in the intermediate passage; an end, facing the second cavity, of the drainage pipe is set tilted.

8. The compressor as claimed in claim 2, wherein the first compression part comprises a first cylinder; the second compression part comprises a second cylinder; the first cylinder and the second cylinder are superposed; the compressor further comprises a division plate disposed between the first cylinder and the second cylinder and a first flange disposed below the first cylinder; the intermediate passage is formed on an assembly consisting of the first cylinder, the second cylinder, the division plate and the first flange.

9. The compressor as claimed in claim 8, wherein the compressor comprises:

a first through hole arranged on the second cylinder;

a second through hole communicated with the first through hole and arranged on the division plate;

a third through hole communicated with the second through hole and arranged on the first cylinder; and a fourth through hole communicated with the third through hole and arranged on the first flange, wherein, internal faces of the first through hole, the second through hole, the third through hole and the fourth through hole form the intermediate passage.

10. The compressor as claimed in claim 9, wherein a side, far away from the first cylinder, of the first flange is provided with a first cavity, and the fourth through hole is in communication with or isolated from the first cavity.

11. A compressor having an intermediate passage capable of conveying accumulated oil to a second compression part, comprising:

a first compression part;

a second compression part;

an intermediate cavity, refrigerant discharged from the first compression part entering the intermediate cavity; and an intermediate passage, the intermediate passage communicating with the intermediate cavity and an inner cavity of the second compression part; a bottom port of the intermediate passage is located at a bottom of the intermediate cavity; only the refrigerant discharged from the first compression part is used to convey the accumulated oil in the intermediate cavity to the inner cavity of the second compression part, wherein at least a part of the intermediate passage is disposed outside of a housing assembly of the compressor; wherein an inlet end of the intermediate passage is disposed at the bottom of the intermediate cavity;

the compressor further comprises:

a first flange disposed below the first compression part, a lower side of the first flange being provided with a first cavity; and a first cover plate disposed below the first flange, a side, facing the first flange, of the first cover plate being provided with a second cavity; the first cavity and the second cavity form the intermediate cavity together; and an inlet end of the intermediate passage is disposed on a bottom wall of the second cavity.

12. The compressor as claimed in claim 11, wherein the intermediate passage comprises a first flow passage section and a second flow passage section communicating with the first flow passage section; the first flow passage section is located outside of the housing assembly, and the second flow passage section is located inside the housing assembly; an end, far away from the second flow passage section, of the first flow passage section communicates with the inner cavity of the second compression part, and an end, far away from the first flow passage section, of the second flow passage section is disposed at the bottom of the intermediate cavity.

13. The compressor as claimed in claim 11, wherein a groove is further disposed on the first cover plate; the intermediate passage communicates with the second cavity through the groove.

14. The compressor as claimed in claim 11, further comprising: an air supplement passage; the air supplement passage communicates with the intermediate passage and the inner cavity of the second compression part respectively.

15. The compressor as claimed in claim 14, wherein the second compression part comprises a second cylinder, and the air supplement passage is disposed on the second cylinder.

16. An air conditioner, comprising a compressor, wherein the compressor is the compressor as claimed in claim 1.

17. An air conditioner, comprising a compressor, wherein the compressor is the compressor as claimed in claim 11.

* * * * *